US008256529B2

(12) United States Patent
Piipponen

(10) Patent No.: US 8,256,529 B2
(45) Date of Patent: Sep. 4, 2012

(54) ARRANGEMENT FOR EMPLOYING DRILL STEEL CENTRALIZER TRAVELLING ON FEED BEAM OF ROCK DRILL MACHINE

(75) Inventor: Juha Piipponen, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 190 days.

(21) Appl. No.: 12/600,731

(22) PCT Filed: May 15, 2008

(86) PCT No.: PCT/FI2008/050274

§ 371 (c)(1),
(2), (4) Date: Nov. 18, 2009

(87) PCT Pub. No.: WO2008/142201

PCT Pub. Date: Nov. 27, 2008

(65) Prior Publication Data

US 2010/0139941 A1 Jun. 10, 2010

(30) Foreign Application Priority Data

May 18, 2007 (FI) ..... 20075361

(51) Int. Cl.
*E21B 19/24* (2006.01)
*E21B 19/086* (2006.01)

(52) U.S. Cl. ..... 173/194; 173/24; 173/25; 173/26; 173/27; 173/28; 173/31; 173/184; 173/160

(58) Field of Classification Search ..... 173/24–28, 173/31, 184, 160, 194
See application file for complete search history.

(56) References Cited

U.S. PATENT DOCUMENTS

| | | | | |
|---|---|---|---|---|
| 2,333,487 | A * | 11/1943 | Nast | 173/141 |
| 3,642,075 | A * | 2/1972 | Wills | 173/189 |
| 3,744,575 | A * | 7/1973 | Strommes | 173/31 |
| 4,194,419 | A * | 3/1980 | Mitchhart et al. | 81/57.33 |
| 4,207,805 | A * | 6/1980 | Jonsson | 91/508 |
| 4,537,263 | A * | 8/1985 | Bjor | 173/1 |
| 4,972,911 | A * | 11/1990 | Rajakallio | 175/220 |
| 5,701,962 | A * | 12/1997 | Jantunen | 175/24 |
| 5,884,712 | A * | 3/1999 | Hakkinen | 173/11 |
| 5,988,298 | A * | 11/1999 | Cheng et al. | 173/147 |
| 7,617,884 | B2 * | 11/2009 | Rubie | 173/11 |

FOREIGN PATENT DOCUMENTS

| | | |
|---|---|---|
| CA | 1310629 | 11/1992 |
| FI | 74778 | 11/1987 |

OTHER PUBLICATIONS

International Search Report mailed Sep. 24, 2008 issued in PCT Application No. PCT/FI2008/050274.

* cited by examiner

*Primary Examiner* — Brian D Nash
*Assistant Examiner* — Michelle Lopez
(74) *Attorney, Agent, or Firm* — Morgan, Lewis & Bockius LLP

(57) ABSTRACT

The invention relates to an arrangement for employing a drill steel centralizer travelling on a feed beam of a rock drill machine. The drill steel centralizer has a pressure fluid-operated actuator for closing a transfer opening intended for a drill rod during drilling, whereby pressure fluid is fed into the actuator during drilling.

14 Claims, 3 Drawing Sheets

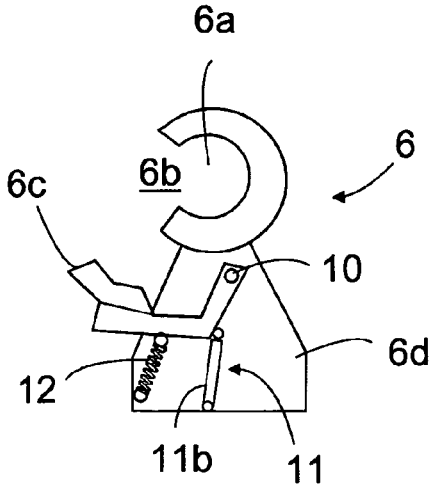
Fig. 2a
Fig. 2b
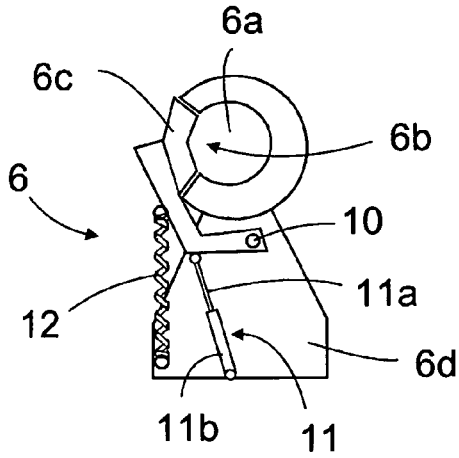
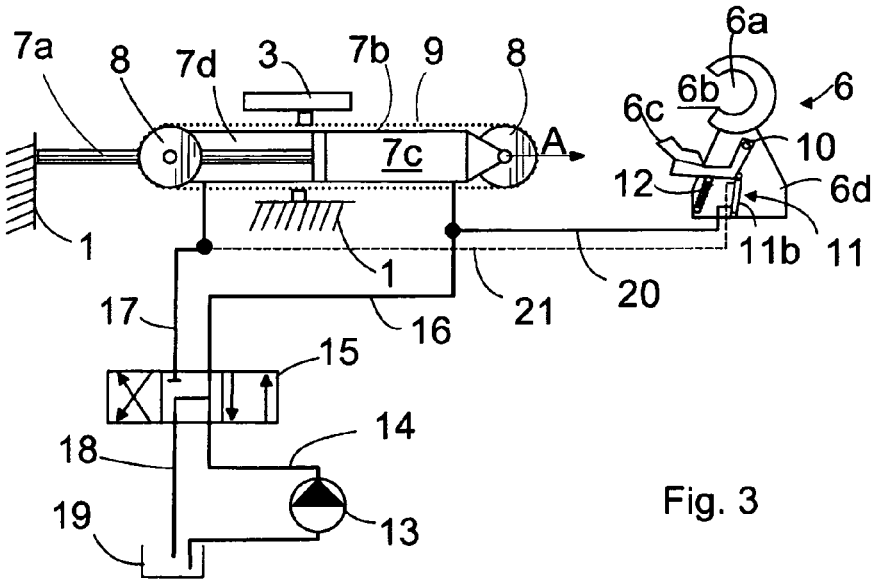
Fig. 3

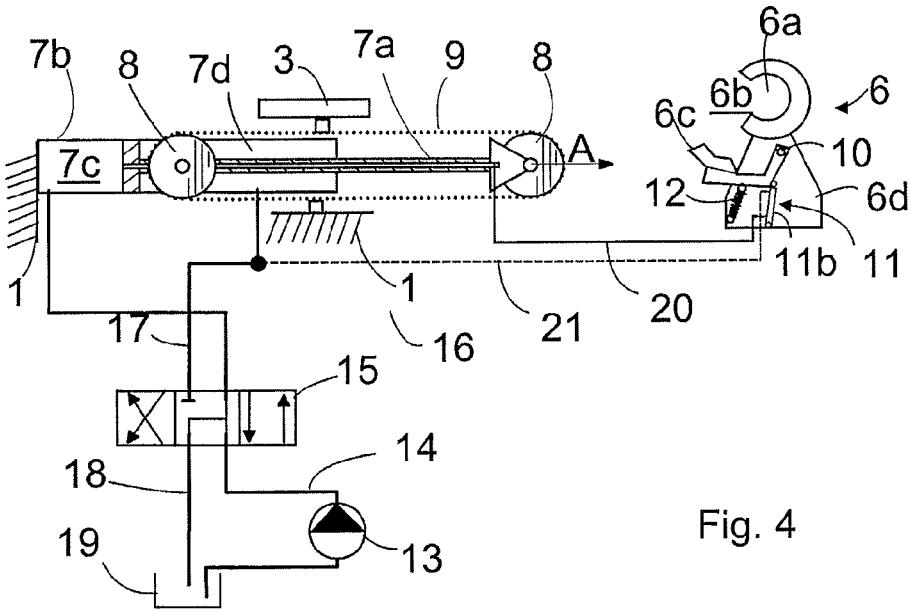
Fig. 4
Fig. 5a
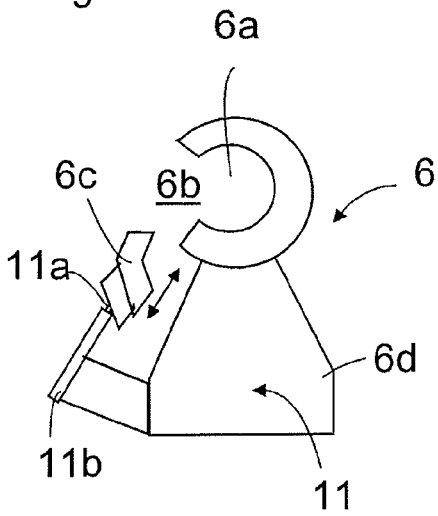
Fig. 5b
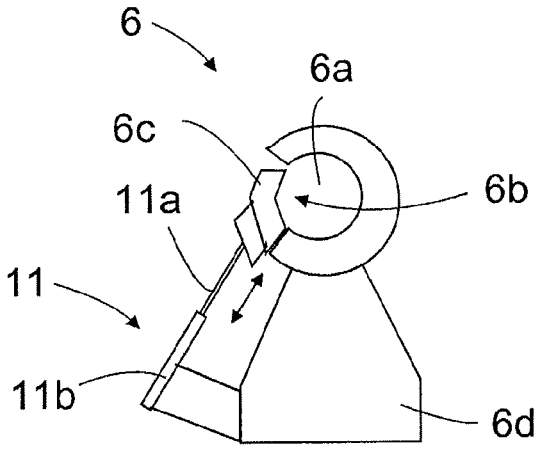

ARRANGEMENT FOR EMPLOYING DRILL STEEL CENTRALIZER TRAVELLING ON FEED BEAM OF ROCK DRILL MACHINE

CROSS REFERENCE TO RELATED APPLICATIONS:

This application is a §371 National Stage Application of International Application No. PCT/FI2008/050274, filed May 15, 2008, and claims priority under 35 U.S.C. §119 and/or §365 to Finnish Application No. 20075361, filed May 18, 2007.

BACKGROUND OF THE INVENTION

The invention relates to an arrangement for employing a drill steel centralizer travelling on a feed beam of a rock drill machine, the arrangement comprising a feed cylinder for moving the drill machine in the drilling direction and back, at least one turning wheel mounted stationary in relation to the feed cylinder and a flexible feed member running around it and connected both to the drill machine and the feed beam, a drill steel centralizer mounted to travel on the feed beam and stationary in relation to the feed cylinder in the longitudinal direction of the feed beam and having a central opening for a drill rod, a transfer opening at the side of the central opening for transferring the drill rod to the central opening and away from it and means for closing the transfer opening during drilling, and pressure fluid channels for feeding pressure fluid in to and out of the pressure fluid chambers of the feed cylinder.

When using long drill rods, and especially in long hole drilling, a drill steel centralizer travelling on the feed beam is generally used to support the drill rods; the centralizer being located between the drill machine and the drill steel guide at the front end of the feed beam and travelling on the feed beam as the drill machine moves. To produce the feed and return movement of the drill machine, very often a feed cylinder is used that is connected to move a wire or chain connected to the drill machine carriage. A change in the length of the feed cylinder then produces the movement of the drill machine. In known structures the longitudinal movement of the feed beam produces a movement of twice the length for the drill machine with the same ratio for the rates of travel. Typically the centralizer in connected to move with the moving part of the feed cylinder, i.e. the cylinder tube or piston depending on the used solution. Generally the piston rod of the feed cylinder is at its end connected stationary in relation to the feed beam, and the cylinder tube moves to produce the feed movement.

In general a centralizer is used that has an opening at the location at which the drill rod is brought to the drill machine. A problem with this solution is that the drill rod at times slips away from the centralizer, which means that drilling must be stopped and the drill rod wrenched back to the centralizer.

BRIEF DESCRIPTION OF THE INVENTION

It is an object of the present invention to provide an arrangement in which the opening of the centralizer can be automatically closed and correspondingly opened during the use of the drill machine in an easy and simple manner.

The arrangement of the invention is characterized in that the centralizer has a pressure fluid-operated actuator for closing the transfer opening, that a pressure fluid channel is connected from the feed cylinder chamber, to which pressure fluid is fed during drilling to move the drill machine in the drilling direction, to the actuator of the centralizer in such a manner that the pressure of the pressure fluid makes the actuator close the transfer opening.

An essential idea of the invention is that the centralizer has an actuator that closes the opening for bringing in and removing the drill rod during drilling. Another essential idea of the invention is that the pressure fluid-operated actuator is connected to the pressure fluid chamber of the feed cylinder so that when the drill machine feed is switched on, the pressurized medium in the pressure fluid chamber of the feed cylinder acts on the actuator and makes it transfer a dosing member to the opening.

The arrangement of the invention provides the advantage that the centralizer can be closed during drilling, which means that the drill rod cannot slip away. The closure also takes place automatically when the drill machine feed is switched on, whereby the user need not take care of it.

BRIEF DESCRIPTION OF THE FIGURES

The invention is described in more detail in the attached drawings in which

FIGS. 2*a* and 2*b* are schematic representations of an open and closed centralizer of rock drill equipment in the longitudinal direction of a drill rod.

FIG. 3 is a schematic representation of a pressure connection for driving a centralizer.

FIG. 4 is another schematic representation of a pressure connection for driving a centralizer.

FIGS. 5*a*-5*b* are schematic representations of another embodiment of an open and closed centralizer of rock drill equipment in the longitudinal direction of a drill rod.

DETAILED DESCRIPTION OF SOME EMBODIMENTS OF THE INVENTION

Figure 1:
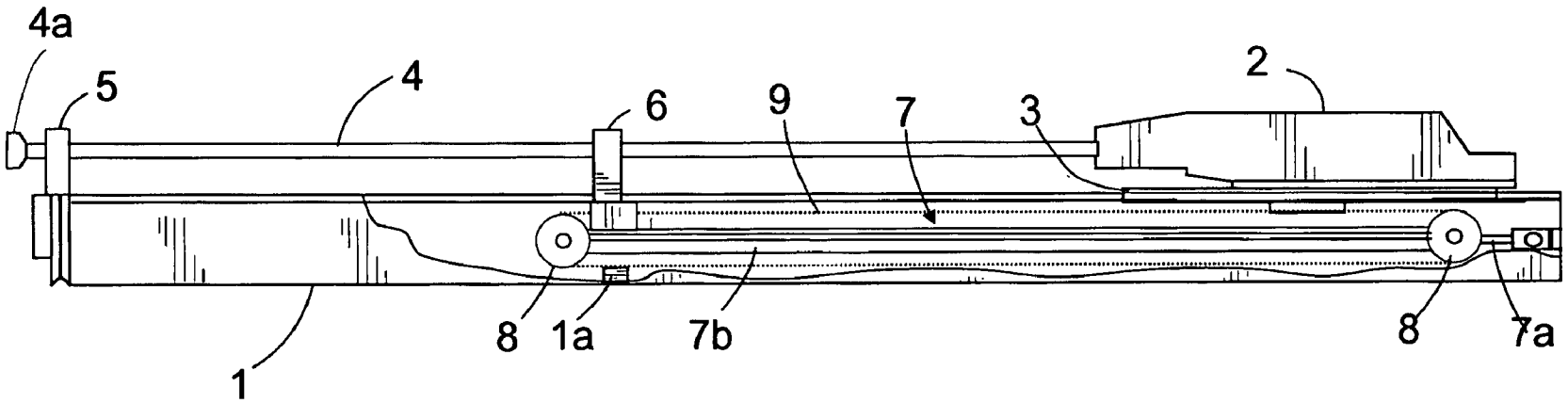
FIG. 1 is a schematic side representation of a feed beam of rock drill equipment with a drill machine and guide.

FIG. 1 is a schematic representation of a partially cut feed beam 1 of rock drill equipment having on top of it a drill machine 2 mounted movably in the longitudinal direction on the feed beam 1. Typically, the drill machine 2 is mounted on to a carriage 3 mounted movably in a known manner on the feed beam 1, but instead of the carriage 3, the drill machine 2 may be connected directly to the feed beam 1 to be movable in its longitudinal direction. In the longitudinal direction of the feed beam from the drill machine towards the drilling direction, there is a drill rod 4, to the end of which a drill bit 4*a* or a second drill rod can be connected depending on the drill equipment and drilling method. Further, at the other end of the feed beam 1, there is a drill steel guide 5 having a hole for the drill rod. Between the drill steel guide 5 and drill machine 2, there is also a centralizer 6, the general operation and structure of which are described later with reference to FIGS. 2*a* and 2*b*. The centralizer 6 also has an opening through which the drill rod 4 passes during drilling.

Inside the feed beam 1, there is a feed mechanism with a feed cylinder 7, turning wheels 8, and a flexible feed member 9. The flexible feed member 9 may be a wire, chain, or some other corresponding flexible and longitudinally sufficiently strong member. At its ends, the feed member 9 is typically connected stationary to the feed beam 1 by means of a bracket 1*a*, for instance, and it runs around the turning wheels 8. The flexible feed member 9 is further connected to the drill machine carriage 3 in the area between the turning wheels 8 or alternatively directly to the drill machine 2. An end of a piston rod 7*a* of the feed cylinder 7 is in a manner known per se connected to the feed beam 1 to be longitudinally stationary.

When pressure fluid is fed to one end of a cylinder tube 7*b* of the feed cylinder, i.e. in the case shown in the figure, to the cylinder chamber on the drill steel guide 5 side, the cylinder tube 7*b* moves toward the drill steel guide 5 forcing the flexible feed member 9 to run around the turning wheels 8. As a result of this, the drill machine moves toward the drill steel guide at a rate that is twice the rate of the cylinder tube 7*b*. As the centralizer 6 is connected longitudinally stationary in relation to the cylinder tube 7*b*, the centralizer 6 correspondingly moves at half the rate of the drill machine and its position at approximately halfway between the drill machine 2 and drill steel guide 5 remains the same during the feed movement, during drilling, and during the return movement of the drill machine.

Differing from what is stated above, the feed cylinder 7 can be connected to the feed beam 1 in the opposite way so that the cylinder tube 7*b* is longitudinally stationary in relation to the feed beam and the piston rod 7*a* moves. In such a case, the centralizer and turning wheels are naturally connected to move with the piston rod 7*a*. The pressure fluid can then be led to the actuator 11 through the piston rod 7*a* and, if necessary, back again inside it.

FIGS. 2*a* and 2*b* and 5*a* and 5*b* are schematic representations of an embodiment of the centralizer 6 as seen from the axial direction of the drill rod. FIG. 2*a* and FIG. 5*a* show the centralizer 6 open. The centralizer 6 has a central opening 6*a* in which the drill rod is during drilling. At the side of the central opening 6*a* , the centralizer 6 has a transfer opening 6*b* through which the drill rod can be transferred in the transverse direction of the centralizer to the central opening 6*a* or away from it. FIG. 2*a* further shows a closing member 6*c* that is by way of example connected to the centralizer 6 to turn by means of an axle 10. The axle 10 may naturally be a bolt or some other generally known fastener around which the closing member 6*c* may turn. A pressure fluid-operated actuator 11 acts between the closing member 6*c* and centralizer 6 frame 6*d*, and by means of it the closing member can be turned to dose the opening 6*b* . Between the closing member 6*c* and centralizer frame 6*d*, there is a spring 12, for instance, to pull the closing member 6*c* away from the opening 6*b* when the pressure of the pressure fluid does not act on the actuator 11. This way, the closing member is away from the opening always when the feed of the drill machine is not switched on. The actuator 11 is for instance a conventional pressure fluid cylinder known per se. Its piston rod 11*a* end is connected to the arm of the closing member 6*c* , for instance, and correspondingly, the cylinder tube is connected to the centralizer 6. The pressure fluid chamber of the cylinder tube 11*b* is connected with a suitable tube or pipe to the pressure fluid chamber of the drill machine feed cylinder in accordance with the diagram described later in connection with FIG. 3, whereby the pressure fluid acting in the pressure fluid chamber of the feed cylinder pushes the piston and thus also the piston rod 11*a* out of the cylinder tube 11*b* and, as a result of this, makes the closing member 6*c* turn in front of the opening 6*b* . FIG. 5*a* shows the closing member 6*c* that is by way of example connected to the centralizer 6 to move linearly in the transverse direction of the feed beam.

FIG. 2*b* is a schematic representation of the centralizer of FIG. 2*a* in a situation where the transfer opening 6*b* of the centralizer 6 is closed. FIG. 5*b* is a schematic representation of the centralizer of FIG. 5*a* in a situation where the transfer opening 6*b* of the centralizer 6 is closed.

FIG. 3 is a schematic representation of a hydraulic coupling that may be used in the implementation of the arrangement of the invention. It shows a pressure fluid pump 13 from which the pressure fluid is led through a channel 14 to a valve 15 and on through a channel 16 to the feed cylinder 7 and into its pressure fluid chamber 7*c*. Correspondingly, from a second pressure fluid chamber 7*d* of the feed cylinder 7, a channel 17 leads to the valve 15, and from the valve 15, a channel 18 leads to a pressure fluid tank 19. By way of example, the valve 15 is here in its idle position, which means that no pressure fluid is fed to the feed cylinder. From the pressure fluid chamber 7*c* of the feed cylinder 7, a channel 20 leads to the actuator 11 of the centralizer 6. By way of example, the actuator 11 is here a single-acting actuator or switched as such. When the feed of the drill machine 2 is switched on, the valve 15 is moved from its idle position shown in the figure to the left so that the pressure fluid from the pressure fluid pump 13 flows through channels 14 and 16 to the cylinder chamber 7*c* of the feed cylinder 7. As a result of this, the cylinder tube 7*b* begins to move towards arrow A, whereby its length increases and the earlier described feed movement of the drill machine is generated. At the same time, the pressure fluid in the chamber 7*c* acts through the channel 20 on the actuator 11 of the centralizer 6 and makes its piston 11*a* push out of the cylinder, which pushes the closing member 6*c* to the transfer opening 6*b* . Instead of a separate closing member, the piston rod 11*a* may act as the closing member. Correspondingly, when the valve 15 is moved to the right in the figure, the pressure fluid flows from the pressure fluid pump 13 through the channel 14, valve 15, and channel 17 into the cylinder chamber 7*d* of the feed cylinder, whereby the cylinder tube 7*b* moves away from the guide 5 and moves the drill machine 2 and centralizer 6 into the same direction. At the same time, the pressure fluid flows away from the cylinder chamber 7*c* through the channel 16, valve 15, and channel 18 to the pressure fluid tank 19. The pressure then stops acting in the centralizer 7 actuator 11, and the spring 12 described earlier in FIGS. 2*a* and 2*b* pulls the closing member 6*c* away from the transfer opening 6*b* . FIGS. 5*a*-5*b* are schematic representations of another embodiment of an open and closed centralizer of rock drill equipment in the longitudinal direction of a drill rod.

By way of example, the valve 15 is shown in such a manner that when it is in its idle position shown in FIG. 3, the pressure fluid may discharge from the cylinder chamber 7*c* of the feed cylinder 7 and pump 13 to the pressure fluid chamber 19. The pressure then decreases, and its effect on the actuator 11 stops. As a result of this, the spring returns the actuator to a position in which the transfer opening 6*b* is open.

FIG. 3 also shows with a dashed line a channel 21 that is needed in an embodiment of the invention. Here, a double-acting actuator is used, in which moving the closing member in both directions is always done with the pressure of the pressure fluid. Thus, in this embodiment, a channel 21 is connected from the feed cylinder 7 chamber 7*d*, to which pressure fluid is fed to move the drill machine 2 in its return direction, to the centralizer 6 actuator 11 so that the pressure of the pressure fluid in the feed cylinder 7 chamber 7*d* during the return movement of the drill machine also acts on the actuator 11 and makes the actuator 11 move the closing member 6*c* away from the transfer opening 6*b*.

The actuator 11 may be either a single- or double-acting pressure fluid cylinder or some other single- or double-acting actuator, such as a pressure fluid motor.

In the above description and drawings, the invention is described by way of example only and it is not in any way restricted thereto. The closing member of the centralizer may be connected to move in a different manner with either a turning movement or linear movement. Further, the actuator may as described be single-acting so that its return movement is generated with a spring or the like, and the closing movement by feeding pressure fluid thereto. Alternatively, the actuator may be implemented as a double-acting actuator so that the effect of the pressure fluid on one feed cylinder chamber generates the closing movement and correspondingly in the other cylinder chamber the opening movement. The feed cylinder is above described in such a manner that the cylinder tube or piston rod is connected to the back end of the feed beam, i.e. stationary to the drill machine side end, whereby during the feed movement the piston pushes out of the cylinder tube and the total length of the feed cylinder increases. Feed may also be done in such a manner that the cylinder tube or piston rod is connected stationary to the front end of the feed beam, i.e. the drill bit side end. During the feed movement, the piston then pulls into the cylinder tube and the total length of the feed cylinder decreases. The cylinder chambers and connections between the actuator and cylinder chamber are then naturally selected in accordance with the invention.

The invention claimed is:

1. Arrangement for employing a drill steel centralizer travelling on a feed beam of a rock drill machine, the arrangement comprising a feed cylinder for moving the drill machine in the drilling direction and back, at least one turning wheel mounted stationary in relation to the feed cylinder and a flexible feed member running around it and connected to both the drill machine and the feed beam, a drill steel centralizer mounted to travel on the feed beam and stationary in relation to the feed cylinder in the longitudinal direction of the feed beam and having a central opening for a drill rod, a transfer opening at the side of the central opening for transferring the drill rod to the central opening and away from it and means for closing the transfer opening during drilling, and a plurality of pressure fluid channels for feeding pressure fluid in to and out of a plurality of the pressure fluid chambers of the feed cylinder, wherein the centralizer has a pressure fluid-operated actuator for closing the transfer opening, and wherein one of the plurality of pressure fluid channels is connected from the pressure fluid chamber of the feed cylinder, to which pressure fluid is fed during drilling to move the drill machine in the drilling direction, to the actuator of the centralizer in such a manner that the pressure of the pressure fluid makes the actuator close the transfer opening.

2. An arrangement as claimed in claim 1, wherein a piston rod of the feed cylinder is connected to the feed beam to be longitudinally stationary, that a cylinder tube of the feed cylinder moves in relation to the feed beam in the same direction as the drill machine, and that the centralizer and the turning wheels are connected to the cylinder tube.

3. An arrangement as claimed in claim 1, wherein a cylinder tube of the feed cylinder is connected to the feed beam to be longitudinally stationary, that the piston rod of the feed cylinder moves in relation to the feed beam in the same direction as the drill machine, and that the centralizer and turning wheels are connected to the piston rod.

4. An arrangement as claimed in claim 1, wherein the cylinder tube of the feed cylinder is connected to the feed beam to be longitudinally stationary, wherein the piston rod of the feed cylinder moves in relation to the feed beam in the same direction as the drill machine, and wherein the centralizer and turning wheels are connected to the piston rod, and wherein the channel from the pressure fluid chamber of the feed cylinder to the centralizer actuator is led through the piston rod.

5. An arrangement as claimed in claim 1, wherein a separate closing member is connected to the actuator for closing the transfer opening.

6. An arrangement as claimed in claim 1, wherein the actuator is a pressure medium cylinder.

7. An arrangement as claimed in claim 1, wherein a separate closing member is connected to the actuator for closing the transfer opening and wherein the actuator is a pressure medium cylinder.

8. An arrangement as claimed in claim 1, wherein the closing member is mounted turnable in relation to the centralizer.

9. An arrangement as claimed in claim 1, wherein the closing member is mounted in relation to the centralizer to move linearly in the transverse direction of the feed beam.

10. An arrangement as claimed in claim 1, wherein between the closing member and centralizer, a spring is connected to act on the closing member in such a manner that it tries to move the closing member away from the transfer opening.

11. An arrangement as claimed in claim 1, wherein a pressure fluid is fed to move the drill machine in the return direction to the actuator of the centralizer in such a manner that the pressure of the pressure fluid during the return movement of the drill machine makes the actuator move the closing member away from the transfer opening.

12. An arrangement as claimed in claim 1, wherein a separate closing member is connected to the actuator for closing the transfer opening, and wherein a pressure fluid channel is connected from the pressure fluid chamber of the feed cylinder, to which pressure fluid is fed to move the drill machine in the return direction, to the actuator of the centralizer in such a manner that the pressure of the pressure fluid during the return movement of the drill machine makes the actuator move the closing member away from the transfer opening.

13. An arrangement as claimed in claim 1, wherein a pressure fluid channel leading to the pressure fluid chamber of the feed cylinder, to which pressure fluid is fed during the feed movement of the drill machine, is connected in the valve in such a manner that when the valve is set into an idle position to stop the feed movement, the pressure fluid in the pressure fluid chamber may discharge into a pressure fluid tank, at which time a pressure decrease in the actuator opens the transfer opening.

14. An arrangement as claimed in claim 1, wherein a separate closing member is connected to the actuator for closing the transfer opening, and wherein a pressure fluid channel leading to the pressure fluid chamber of the feed cylinder, to which pressure fluid is fed during the feed movement of the drill machine, is connected in the valve in such a manner that when the valve is set into an idle position to stop the feed movement, the pressure fluid in the chamber may discharge into a pressure fluid tank, at which time a pressure decrease in the actuator opens the transfer opening.

* * * * *